United States Patent [19]

Bricker

[11] 3,985,174

[45] Oct. 12, 1976

[54] PET DOOR

[76] Inventor: Charles O. Bricker, 13861 Otis Place, Poway, Calif. 92064

[22] Filed: June 24, 1975

[21] Appl. No.: 589,756

[52] U.S. Cl. ..... 160/180
[51] Int. Cl.[2] ..... E06B 7/28
[58] Field of Search ..... 160/180; 49/168–171

[56] References Cited

UNITED STATES PATENTS

| | | | |
|---|---|---|---|
| 2,854,072 | 9/1958 | Winnan | 160/180 |
| 3,288,200 | 11/1966 | Gagne | 160/180 |
| 3,545,521 | 12/1970 | Noecker | 160/180 |

*Primary Examiner*—Kenneth Downey

[57] ABSTRACT

A pet door installed in a window screen or screen door consisting of a screen frame member having a frame track in which a spline cord can hold the edge of a cut off portion of a screen door or window together with first and second outer members which are coupled to the center screen frame member, one of the outer members having a hinged center portion for allowing a pet to pass through from either side.

1 Claim, 3 Drawing Figures

PET DOOR

RELATED APPLICATIONS

The present application contains subject matter similar to the disclosure of an application filed June 20, 1974, for PET DOOR, by CHARLES O. BRICKER, Ser. No. 481,139.

BRIEF DESCRIPTION OF THE INVENTION

The present invention relates to a pet door and more particularly to a pet door mounted in a screen door or window.

According to the invention a pet door mounted within a screen door or window is provided in which a center member consists of a screen frame for terminating the edges of a cut out from a conventional screen window or door. This is accomplished conventionally via a spline groove and spline cord. This member is rectangular in shape having grooves on two adjacent sides thereof for mounting in a corner of a screen door or window and receiving a portion of one side frame member and the bottom frame member of the screen door or window in a tongue and groove manner. One outer member has a panel hingedly attached thereto for opening and closing from either side and being constructed of a meterial such as aluminium which a pet can easily open upon contact therewith. Each of two outer members matches the pet door opening. Mounting holes are drilled in each corner thereof for coupling the outer members to the frame work of the center member. The center member preferrably has mounting holes in three of the corners for mounting to the screen door or window frame. The outside members preferrably have an inwardly extending lip which serves to position and strengthen the inner screen member.

An object of the present invention is the provision of a pet door for insertion in a conventional screen door or window screen.

Another object of the invention is the provision of a pet door which utilizes an existing screen frame for structural support.

A further object of the invention is the provision of a pet door which is inexpensive to manufacture and extremely simple to install.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWINGS

Figure 1:
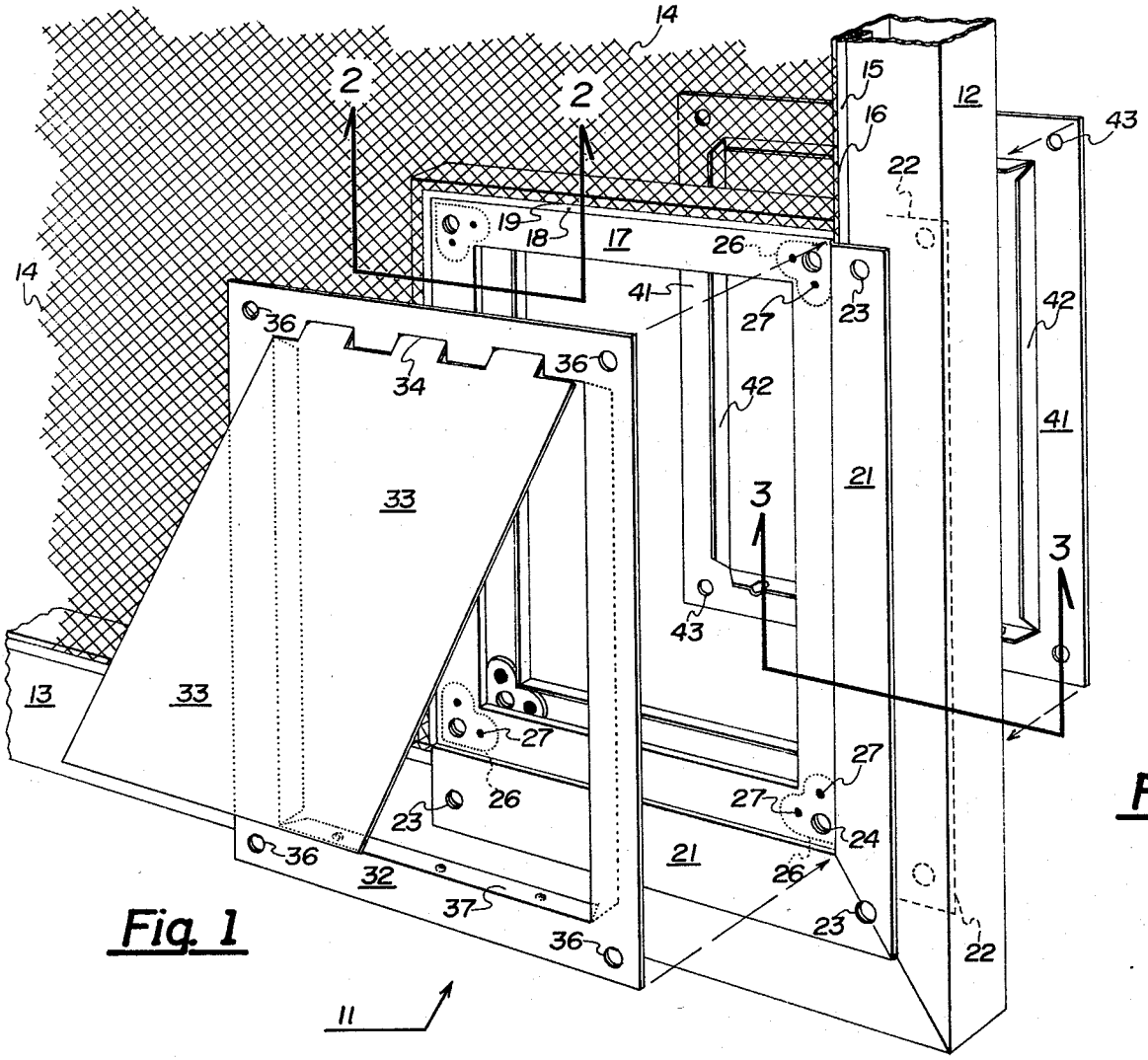
FIG. 1 is an exploded perspective view of the preferred embodiment of the present invention.

Referring to FIG. 1, a section of a screen door or window is shown at 11 having a vertical frame member 12 and a horizontal frame member 13. A screen 14 is shown captured by a spline cord 15 within spline groove 16. Center screen frame member 17 abuts vertical frame member 12 and horizontal frame member 13 and captures the edge of the cut out portion of the screen 14 with a conventional spline cord 18 within spline groove 19. Extensions 21 and 22 receive vertical frame member 12 and horizontal frame member 13 of screen door or window 11 in a tongue and groove fashion. Mounting holes 23 are shown in three corners of extension 21 of inner screen member 17 with identical mounting holes on the opposite side in extension 22. Mounting holes 24 in inner screen frame member 17 extend through tie brackets 26 which are rivoted at 27 to inner screen frame member 17 tieing the vertical and horizontal sections together.

Recess 31 is dimensioned for receiving outer member 32. Outer member 32 carries a door section 33 hinged at 34. Mounting holes 36 align with mounting holes 24 in inner screen frame member 17. Outer frame member 32 has an inner lip 37 dimensioned for being received within inner screen frame member 17.

Outer member 41 has an inwardly extending lip 42 also dimensioned for being received within inner screen frame member 17. Mounting holes 43 cooperate with mounting holes identical to mounting holes 24 on the other side of inner screen frame member 17.

Figure 2:
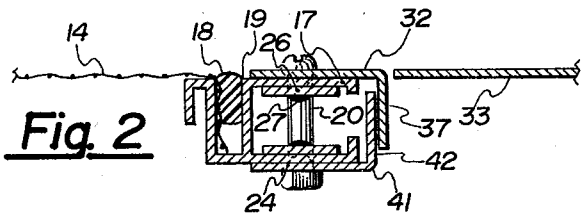
FIG. 2 is a cross sectional view taken along lines 2—2 of FIG. 1 unexploded.
Figure 3:
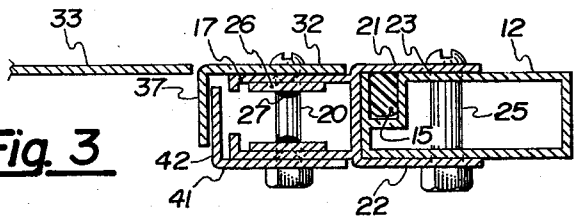
FIG. 3 is a cross sectional view taken along lines 3—3 of FIG. 1 unexploded.

Referring to FIGS. 2 and 3, it can be seen that inner member 17 and outer members 32 and 41 are tied together via a nut and bolt arrangement shown at 20. Extensions 21 and 22 are secured to vertical frame 12 via nut and bolt assembly 25 passing through mounting hole 23.

Referring to all of the Figures, installation will be described. First step is to remove screen door or window member 11 from its outer frame or track. The outside member 41 is then placed on a flat surface such as a cement patio slab. The inner member 17 is then positioned snuggly on the inside of outside member 41. The screen door or window member is then placed on top of this assembly in position for securing. In the case of a patio sliding screen door this would be in the corner beneath the screen door latch. Mounting holes are then marked and drilled as required. Mounting screws and nuts are then placed through the inner member 17 and secured to the screen door. An "X" is then cut in the rectangular portion of the screen defined by inner member 17 and the corner of the screen door frame. Using the spline cord 18, the screen is then forced into spline groove 19 of inner member 17 and the excess screen cut away. Outer member 32 is then placed into recess 31 of inner member 17 and mounting bolts and nuts assemblies 20 are placed into the frame securing the three members together.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A pet door in a window screen or screen door comprising:

a window screen or screen door having a generally rectangular frame with four inner edges bordering and terminating a central screen portion;

a cut out in said screen portion of said screen door or window, said cut out having two edges forming two sides of a rectangle with portions of two inner edges of the window or door frame forming two other sides of said rectangle;

a rectangular central screen frame member having a spline groove, said two edges of said cut out being received by said spline groove;

a spline cord received by said spline groove of said screen cut out edges for holding said screen edges therein;

at least one U-shaped extension extending from at least one edge of said central screen frame member dimensioned for and receiving a portion of at least one of said inner edges and a portion of said rectangular frame;

first and second outside rectangular frame members having substantially the same dimensions as said central screen frame member coupled to said central screen frame member; and a panel hingedly attached to one of said outside members at a top portion thereof for allowing a pet to pass through from either direction.

* * * * *